US007896700B2

(12) United States Patent
Miki et al.

(10) Patent No.: US 7,896,700 B2
(45) Date of Patent: Mar. 1, 2011

(54) SOCKET CONNECTOR

(75) Inventors: Yasuyuki Miki, Shinagawa (JP); Mitsuru Kobayashi, Shinagawa (JP); Kimihiko Omura, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 24 days.

(21) Appl. No.: 12/071,289

(22) Filed: Feb. 19, 2008

(65) Prior Publication Data

US 2009/0068888 A1 Mar. 12, 2009

(30) Foreign Application Priority Data

Sep. 12, 2007 (JP) ..... 2007-236690

(51) Int. Cl.
*H01R 13/648* (2006.01)

(52) U.S. Cl. ..... 439/607.55

(58) Field of Classification Search ..... 439/608, 439/701, 607.06–607.08, 55
See application file for complete search history.

(56) References Cited

U.S. PATENT DOCUMENTS

| | | | | |
|---|---|---|---|---|
| 5,104,341 | A | 4/1992 | Gilissen et al. | |
| 5,664,968 | A | 9/1997 | Mickievicz | |
| 5,795,191 | A * | 8/1998 | Preputnick et al. | 439/607.11 |
| 6,146,202 | A | 11/2000 | Ramey et al. | |
| 6,231,391 | B1 * | 5/2001 | Ramey et al. | 439/607.07 |
| 6,354,877 | B1 | 3/2002 | Shuey et al. | |
| 2001/0012730 | A1 * | 8/2001 | Ramey et al. | 439/608 |
| 2002/0042227 | A1 * | 4/2002 | Nitta | 439/608 |
| 2010/0233906 | A1 * | 9/2010 | Miki et al. | 439/607.55 |

FOREIGN PATENT DOCUMENTS

| | | |
|---|---|---|
| DE | 40 40 551 | 6/1991 |
| EP | 0 881 718 | 12/1998 |
| JP | 2003-529909 | 10/2003 |
| WO | 01/76016 | 10/2001 |

OTHER PUBLICATIONS

European Search Report issued on Feb. 4, 2009 in corresponding European Patent Application No. 08101688.3.

* cited by examiner

*Primary Examiner*—Renee Luebke
*Assistant Examiner*—Larisa Tsukerman
(74) *Attorney, Agent, or Firm*—Staas & Halsey LLP

(57) ABSTRACT

A socket connector is disclosed that includes a housing, multiple contact modules fixed to the housing, and multiple shield members coupled and fixed to the corresponding contact modules. The contact modules and the shield members are alternately arranged in alignment in a longitudinal direction of the housing. The shield members are fixed to the housing.

8 Claims, 18 Drawing Sheets

SOCKET CONNECTOR

CROSS-REFERENCE TO RELATED APPLICATION(S)

This application is related to and claims priority to Japanese Priority Patent Application No. 2007-236690, filed on Sep. 12, 2007, the entire contents of which are hereby incorporated by reference.

BACKGROUND OF THE INVENTION

1. Field of the Invention

The embodiments discussed herein are directed to socket connectors, and more particularly to a socket connector supporting high-speed transmission used to electrically connect circuit boards in communication devices.

2. Description of the Related Art

Communication devices contain a backplane and multiple daughter boards arranged side by side on the backplane at right angles thereto. The backplane has plug connectors mounted thereon. The daughter boards have socket connectors provided at their respective ends. The daughter boards are electrically connected to the backplane by connecting their socket connectors to the corresponding plug connectors.

Recent years have seen increases in signal transmission speed, and differential transmission has often been adopted as a method of signal transmission. This causes socket connectors to be configured to support differential transmission. For example, socket connectors have pairs of contacts for plus signal transmission and minus signal transmission, and also incorporate shield members.

Conventional socket connectors have contact modules and shield members alternately and closely arranged and incorporated in a housing.

Since the contact modules and shield members are closely arranged and incorporated, their rear portions project on the rear side of the housing. Since the rear portions of the contact modules thus project on the rear side of the housing, it is desirable that the contact modules be in sufficiently stable alignment in their assembled state. This is because if one or more of the contact modules come out from the housing during handling such as transportation to disorder their alignment, the contact modules may have to be realigned at the time of mounting the socket connectors on the daughter boards.

According to a conventional socket connector, multiple triangular recesses are formed side by side on the end faces of the rearward projecting parts of a housing, and wedged projections are formed on contact modules. The wedged projections of the contact modules are fitted into the corresponding triangular recesses so that the contact modules are positioned. Further, the contact modules are fixed to the housing with their respective bulge parts. (See, for example, Japanese Laid-Open Patent Application [Japanese translation of PCT international application] No. 2003-529909.)

Conventionally, the contact modules are fixed to the housing with their respective bulge parts, and the shield members are coupled and fixed to the contact modules. The shield members, however, are not fixed to the housing. Accordingly, prevention of the coming-out of the contact modules relies on the strength of their own fixation.

Further, the upper projections of the contact modules are fitted into the corresponding recesses on the end face of the upper projecting part and the lower projections of the contact modules are fitted into the corresponding recesses on the end face of the lower projecting part, so that the contact modules are positioned. Therefore, if the contact modules come out rearward, even if only slightly, from the housing, the contact modules become unrestricted to get loose easily, so that their positions become unstable.

Therefore, it is necessary to handle assembled socket connectors and mount the socket connectors on daughter boards with deliberation.

SUMMARY OF THE INVENTION

According to one embodiment of the present invention, there is provided a socket connector designed in view of the above-mentioned points.

According to one embodiment of the present invention, there is provided a socket connector including a housing, a plurality of contact modules fixed to the housing, and a plurality of shield members coupled and fixed to the corresponding contact modules, wherein the contact modules and the shield members are alternately arranged in alignment in a longitudinal direction of the housing, and the shield members are fixed to the housing.

According to one embodiment of the present invention, there is provided a socket connector including a housing including a main body and a projecting part projecting from the main body; a plurality of contact modules each including a contact member and a plate-shaped main body part enclosing the contact member; and a plurality of shield members, wherein the contact modules and the shield members are alternately arranged in alignment in the housing in a longitudinal direction thereof, the projecting part of the housing includes a plurality of guide grooves configured to guide the corresponding shield members, and each of the shield members includes a bulge part and is fixed to the housing by the bulge part fitting into and biting the corresponding guide groove.

According to one embodiment of the present invention, there is provided a socket connector including a housing including a main body and a projecting part projecting from the main body; a plurality of contact modules each including a contact member and a plate-shaped main body part holding the contact member; and a plurality of shield members, wherein the contact modules and the shield members are alternately arranged in alignment in the housing in a longitudinal direction thereof, each of the contact modules includes a guide rail part and a first bulge part, the guide rail part having a dimension less than a dimension of the main body part in the longitudinal direction of the housing, each of the shield members includes a second bulge part, the projecting part includes alternately arranged first guide grooves and second guide grooves, the first guide grooves corresponding to the guide rail parts and the second guide grooves guiding the shield members, each of the contact modules is fixed to the housing by the guide rail part fitting into the corresponding first guide groove and the first bulge part being fixed to the housing, each of the shield members is fixed to the housing by the second bulge part fitting into and biting the corresponding second guide groove, and the shield members are coupled and fixed to the corresponding contact modules.

According to one aspect of the present invention, shield members are fixed to the housing of a socket connector. Accordingly, the shield members function as anchors against the coming-off of corresponding contact modules from the housing. As a result, the contact modules are prevented from coming out from the housing with a force greater than conventionally, and the contact modules are kept in alignment with greater strength.

BRIEF DESCRIPTION OF THE DRAWINGS

Other objects, features and advantages of the present invention will become more apparent from the following detailed description when read in conjunction with the accompanying drawings, in which:

FIGS. 18B, 18C, and 18D are cross-sectional views of the contact module of FIG. 18A, taken along the line XVIIIB-XVIIIB, according to the embodiment of the present invention.

DETAILED DESCRIPTION OF THE EMBODIMENTS

A description is given below, with reference to the accompanying drawings, of an exemplary embodiment.

Figure 1:
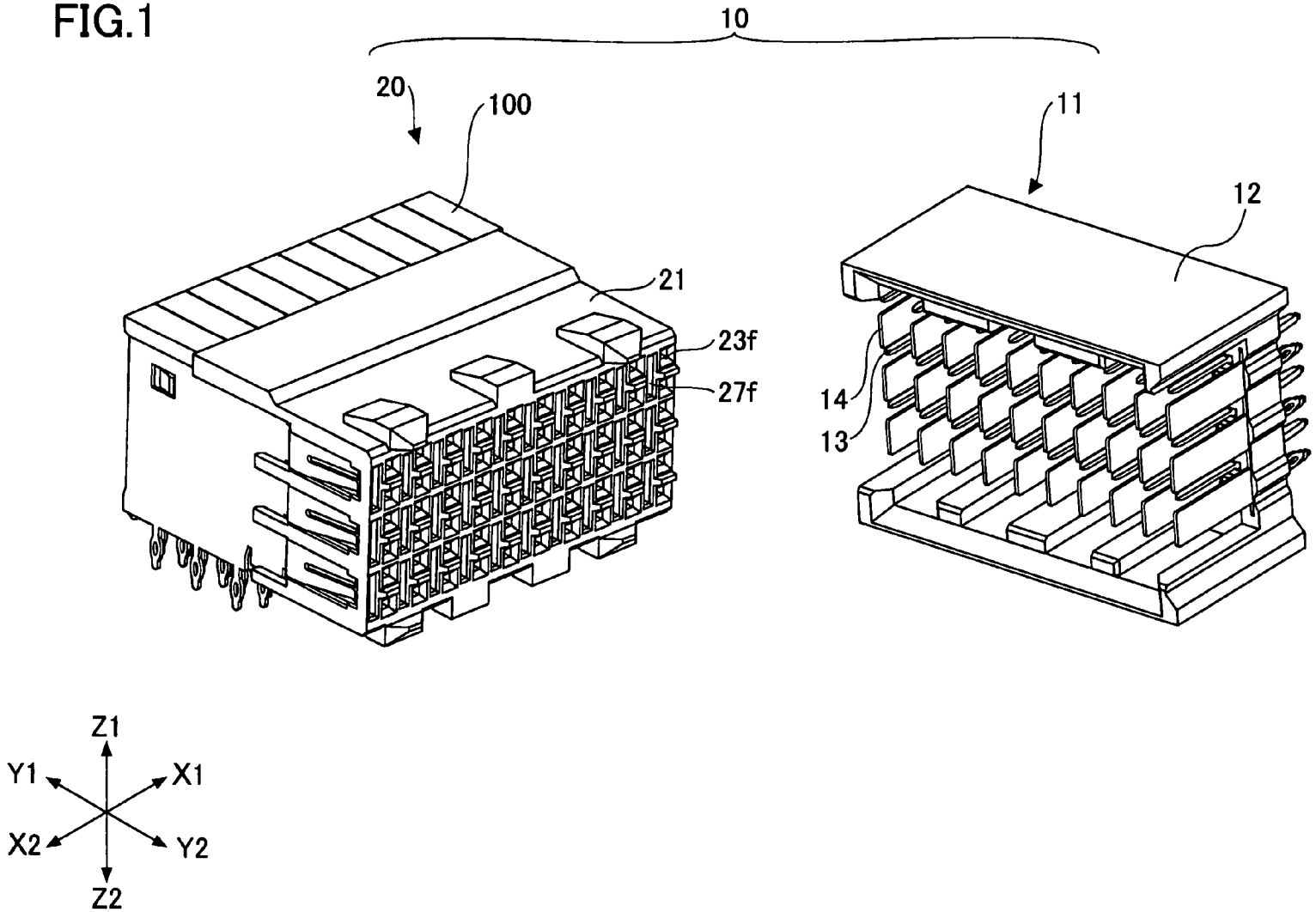
FIG. 1 is a diagram showing a socket connector according to an embodiment of the present invention, together with a plug connector.

FIG. 1 is a diagram showing a socket connector 20 according to the embodiment of the present invention, together with a plug connector 11.

The socket connector 20 is for a daughter board and supports high-speed transmission. The socket connector 20 and the plug connector 11 form a connector unit 10.

Figure 6A:
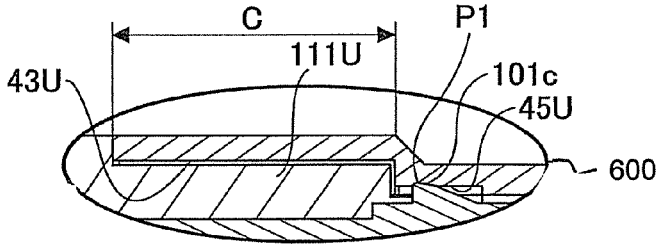
FIGS. 6A, 6B, and 6C are cross-sectional views of the socket connector of FIG. 5 taken along the line VI-VI, showing a contact module incorporated in a housing, according to an embodiment of the present invention.
Figure 6B:
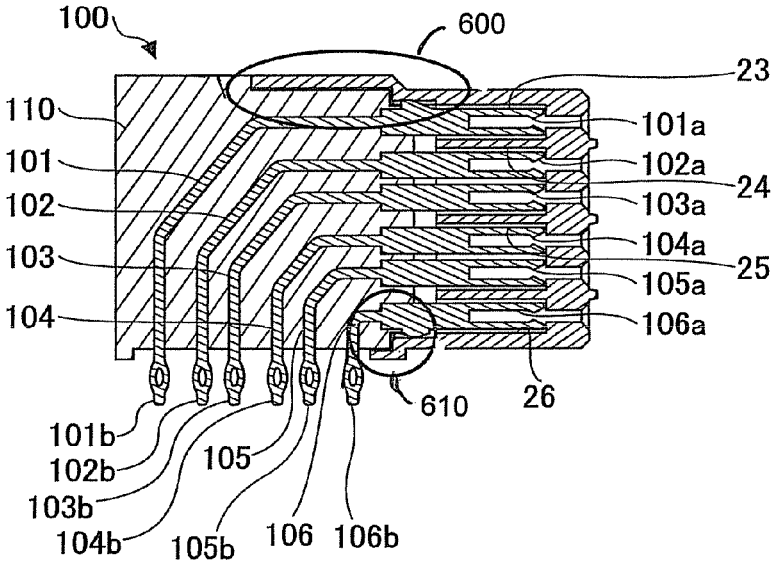
Figure 6C:
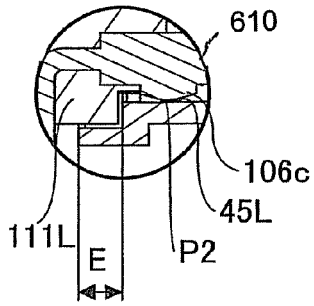
Figure 6C:
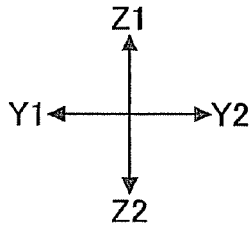

FIGS. 6A and 6C are enlarged views respectively of portion 600 and portion 610 illustrated in FIG. 6B. The socket connector 20 has substantially L-letter shaped contact members 101, 102, 103, 104, 105, and 106 (FIG. 6B) in alignment. The plug connector 11 has pin contacts 13 and shield members 14 aligned inside a housing 12.

Figure 2:
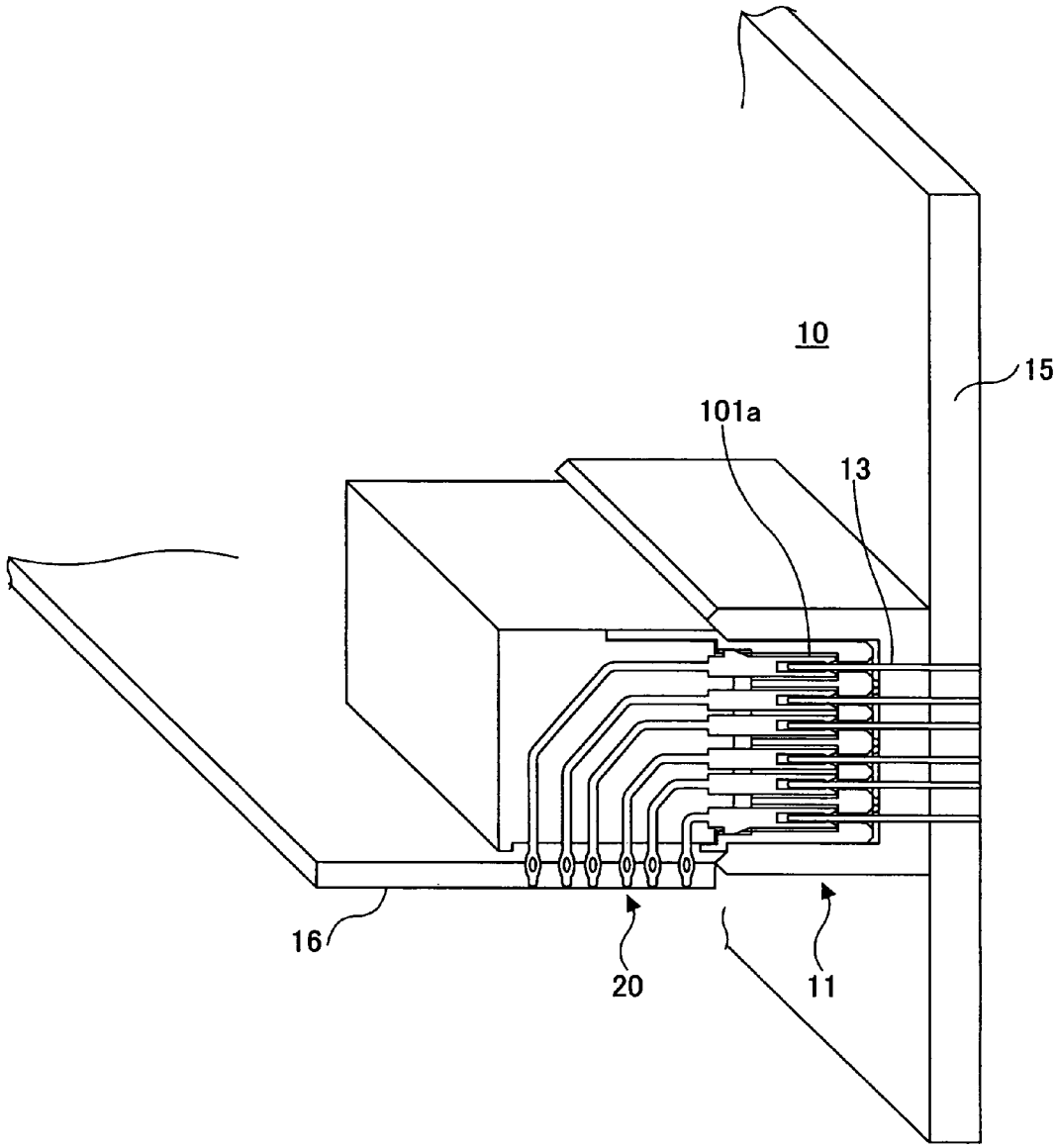
FIG. 2 is a diagram showing the socket connector and the plug connector in a connected state according to the embodiment of the present invention.

FIG. 2 is a diagram showing the socket connector 20 and the plug connector 11 in a connected state.

Referring to FIG. 2, the plug connector 11 is mounted on a backplane 15, and the socket connector 20 is provided at an end of a daughter board 16. The plug connector 11 and the socket connector 20 are connected so that the daughter board 16 is electrically connected to the backplane 15.

Specifically, the pin contacts 13 of the plug connector 11 are inserted into corresponding openings 23*f*, 24*f*1, 24*f*2, 25*f*1, 25*f*2, and 26*f* described below (FIG. 13) of the socket connector 20, so that forked contact parts 101*a*, 102*a*, 103*a*, 104*a*, 105*a*, and 106*a* (FIG. 6B) of the contact members 101, 102, 103, 104, 105, and 106, respectively, of the socket connector 20 and the corresponding pin contacts 13 are fitted to each other to be electrically and mechanically connected. The shield members 14 of the plug connector 11 are inserted into corresponding openings 27*f*, 28*f*, and 29*f* described below (FIG. 14) of the socket connector 20, so that the shield members 14 come into contact with corresponding forked shield piece parts 122, 123, and 124 described below (FIGS. 7A, 7B, and 7C) of the socket connector 20. Thereby, the plug connector 11 and the socket connector 20 are electrically and mechanically connected.

In the drawings, X1-X2 indicates the longitudinal directions, Y1-Y2 indicates the depth (rear-front) directions, and Z1-Z2 indicates the height directions of the socket connector 20. The Y1 side is the rear side and the Y2 side is the front side of the socket connector 20.

FIGS. 3 through 10A and 10B show the socket connector 20.

Figure 3:
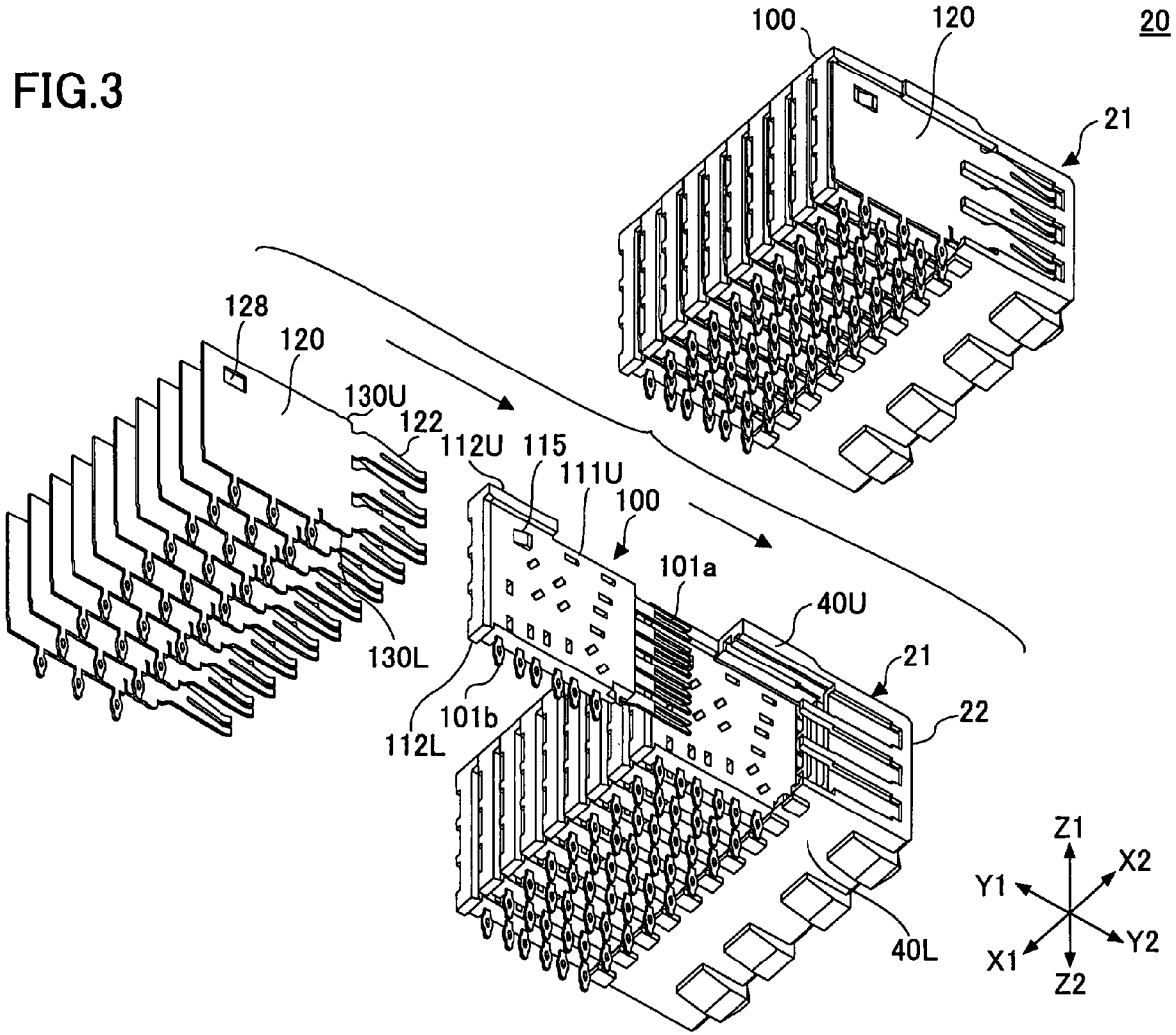
FIG. 3 is a bottom-side exploded perspective view of the socket connector according to the embodiment of the present invention.
Figure 4:
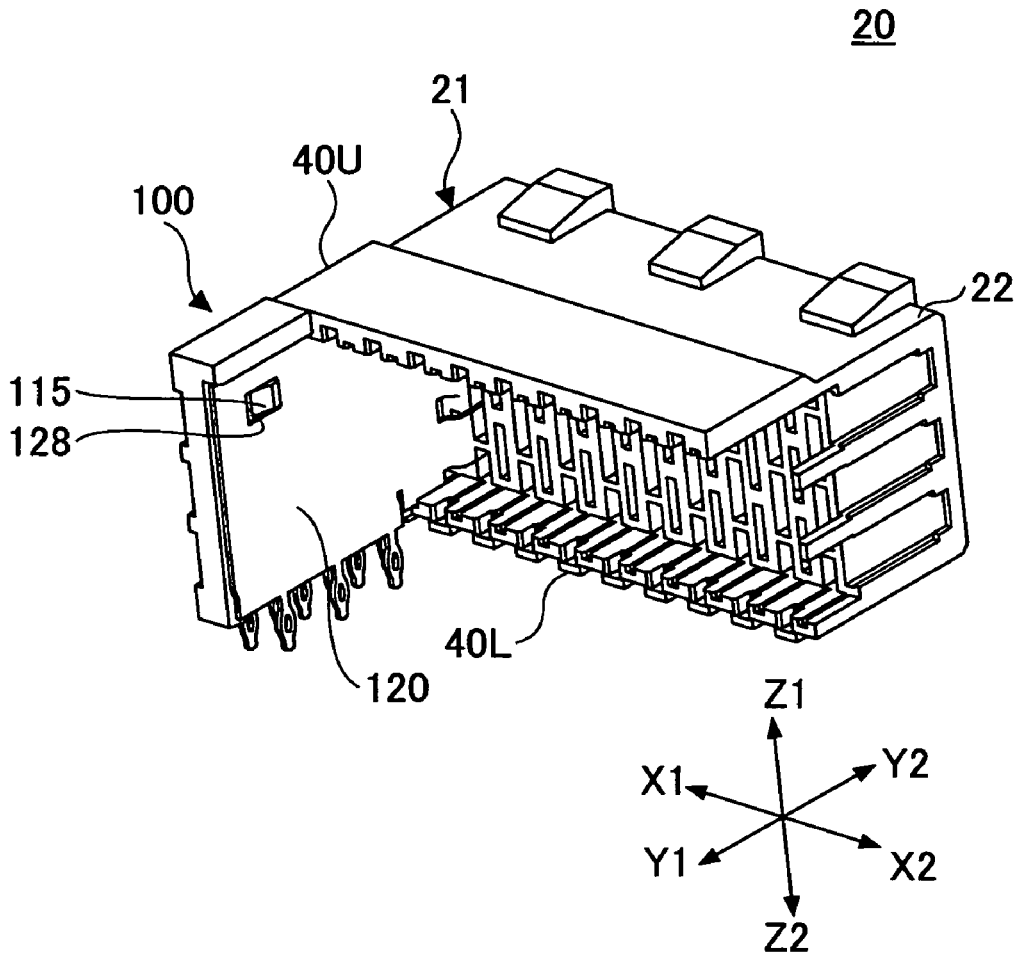
FIG. 4 is a rear-side perspective view of the socket connector having one contact module and one shield member incorporated therein according to the embodiment of the present invention.

FIG. 3 is an exploded perspective view of the socket connector 20. FIG. 4 is a rear-side perspective view of the socket connector 20 having one contact module and one shield member incorporated therein.

Figure 5:
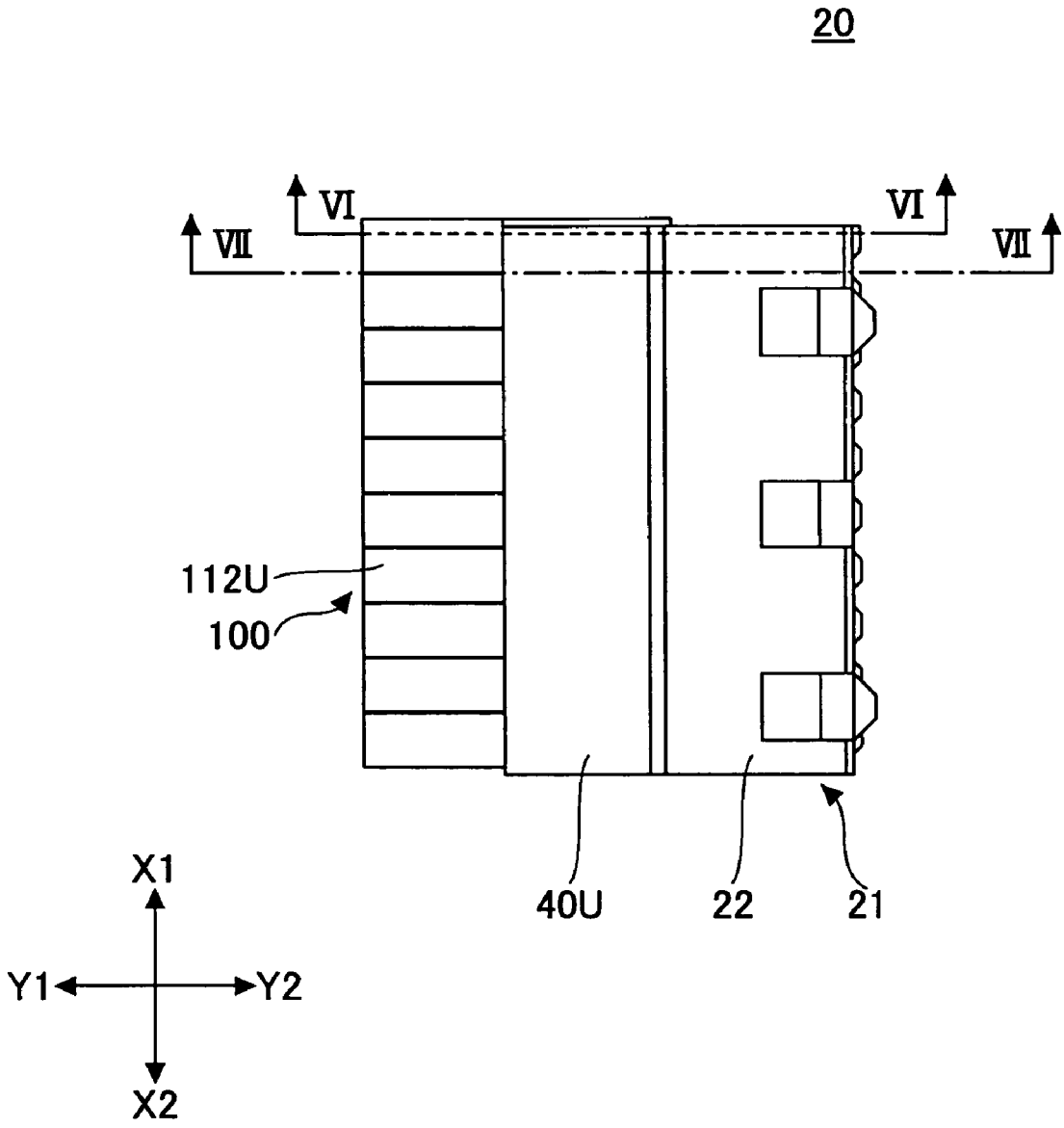
FIG. 5 is a plan view of the socket connector according to the embodiment of the present invention.
Figure 7A:
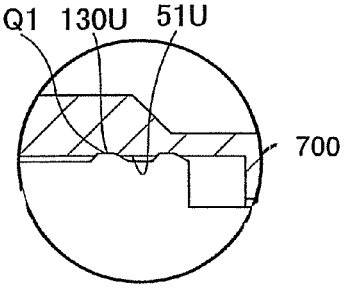
FIGS. 7A, 7B, and 7C are cross-sectional views of the socket connector of FIG. 5 taken along the line VII-VII, showing a shield member incorporated in the housing, according to the embodiment of the present invention.
Figure 7B:
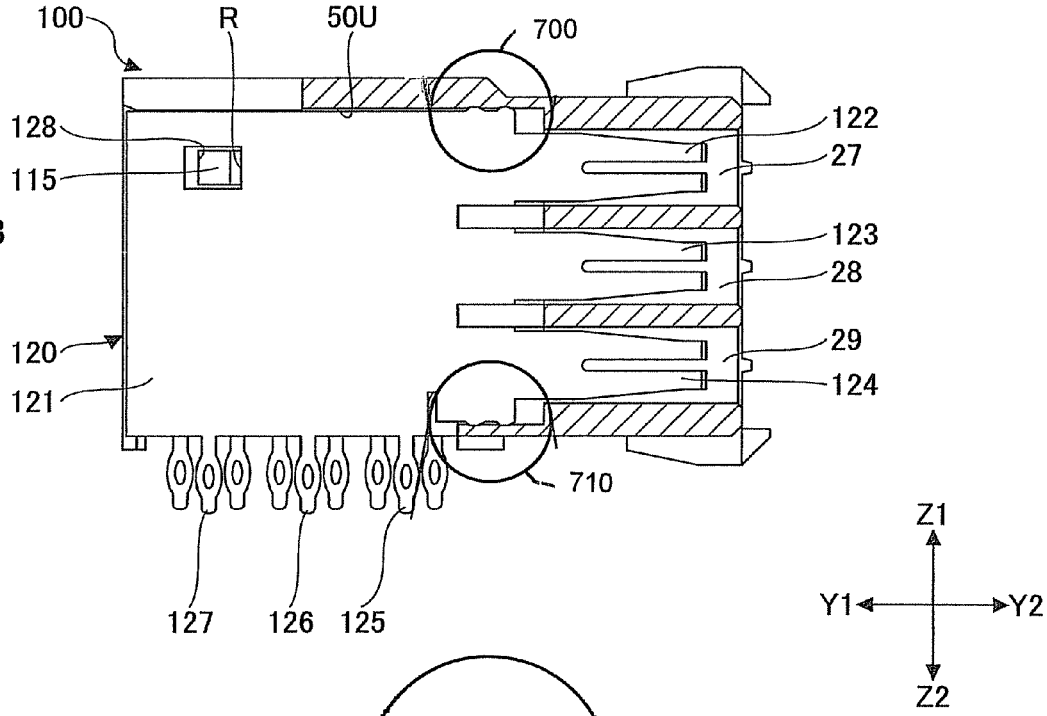
Figure 7C:
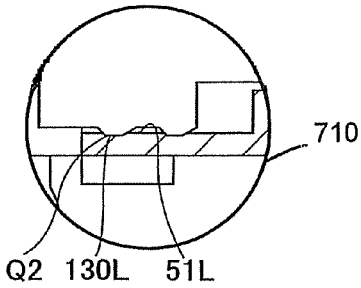

FIG. 5 is a plan view of the socket connector 20. FIGS. 6A, 6B, and 6C are cross-sectional views of the socket connector 20 of FIG. 5 taken along the line VI-VI, showing a contact module incorporated in a housing. FIGS. 7A, 7B, and 7C are cross-sectional view of the socket connector 20 of FIG. 5 taken along the line VII-VII, showing a shield member incorporated in the housing.

Figure 8:
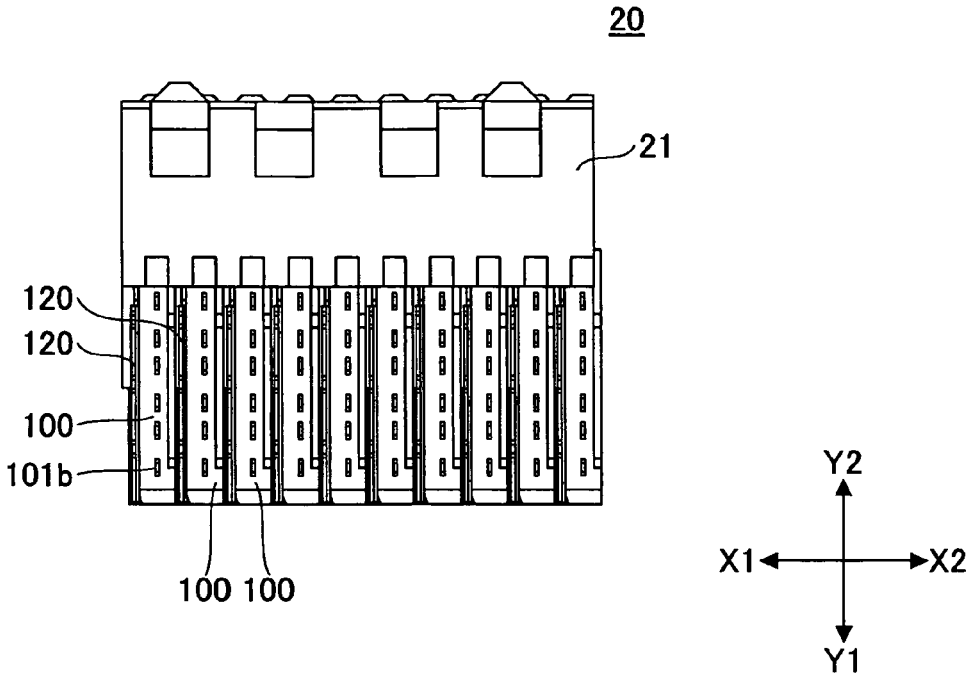
FIG. 8 is a bottom view of the socket connector according to the embodiment of the present invention.
Figure 9:
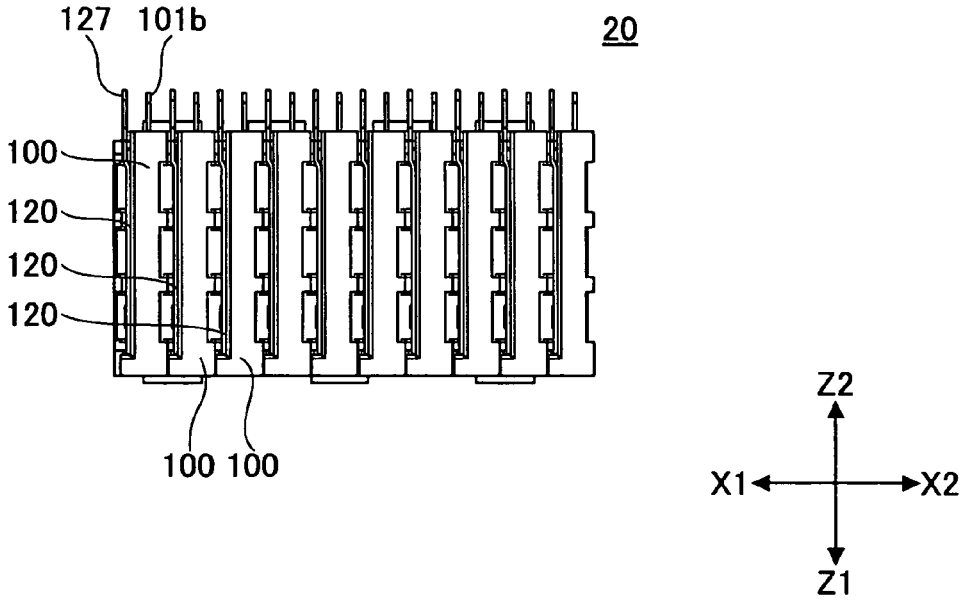
FIG. 9 is a rear side view of the socket connector according to the embodiment of the present invention.
Figure 10A:
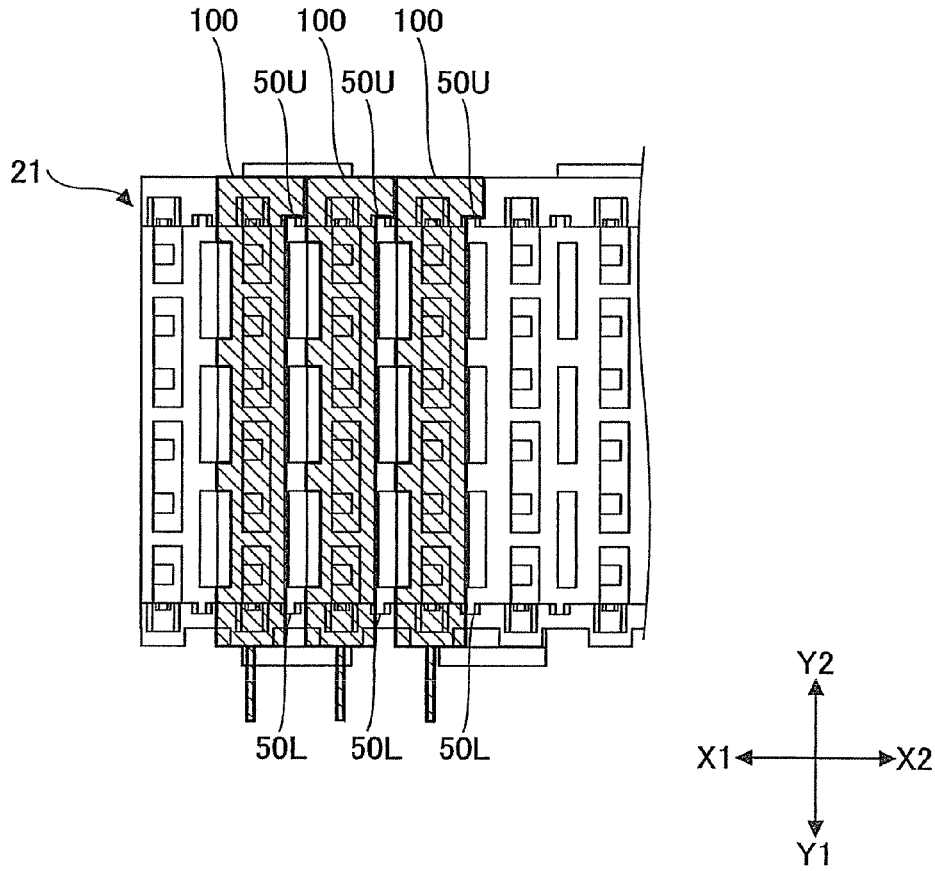
FIGS. 10A and 10B illustrate contact modules incorporated in the housing in alignment according to an embodiment of the present invention.
Figure 10B:
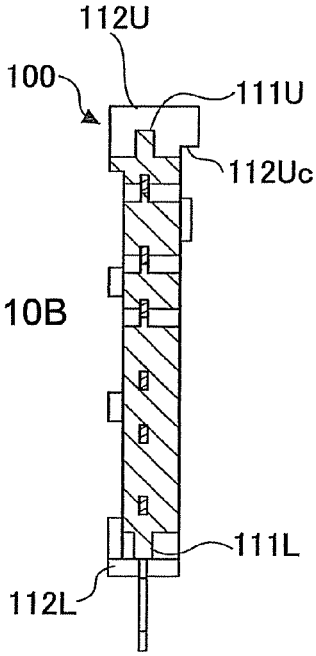

FIG. 8 is a bottom view of the socket connector 20. FIG. 9 is a rear side view of the socket connector 20. FIGS. 10A and 10B illustrate contact modules incorporated in the housing in alignment.

Referring to FIG. 3 through FIGS. 10A and 10B, the socket connector 20 includes a housing 21, contact modules 100, and shield members 120. The contact modules 100 and the shield members 120 are inserted into the housing 21 from its rear side so as to be alternately arranged in the longitudinal directions of the housing 21 (socket connector 20), so that the rear end faces of the contact modules 100 are aligned in a single row.

The socket connector 20, the contact modules 100, and the shield members 120 have substantially symmetrical shapes in the vertical (Z1-Z2) directions, so that their upper and lower corresponding portions are referred to by the same reference numerals with a subscript "U" and a subscript "L," respectively.

A detailed description is given below of fixation of the contact modules 100 and the shield members 120 to the housing 21.

[Configuration of Housing 21]

Figure 11:
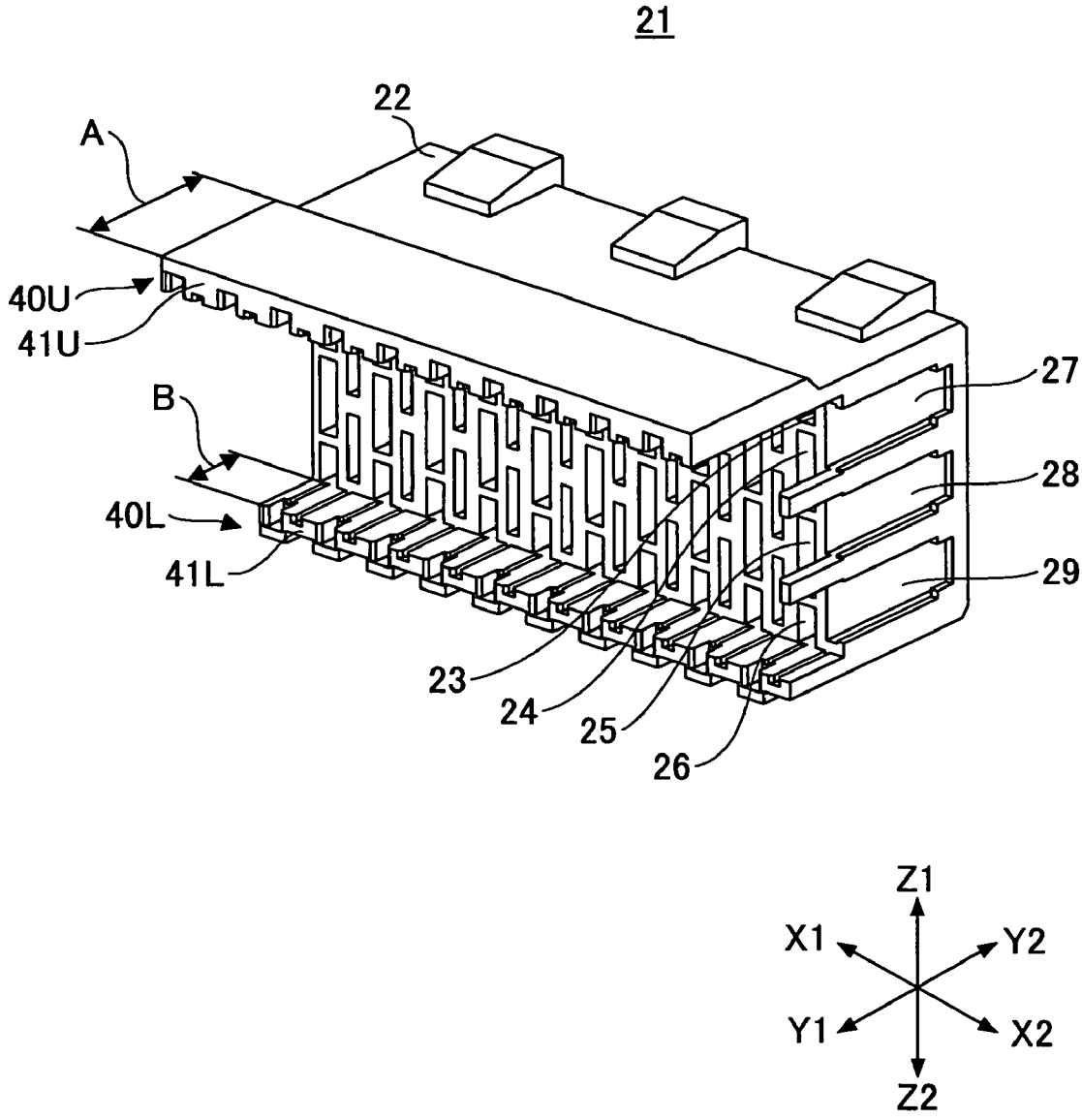
FIG. 11 is a rear-side perspective view of the housing according to the embodiment of the present invention.
Figure 12B:
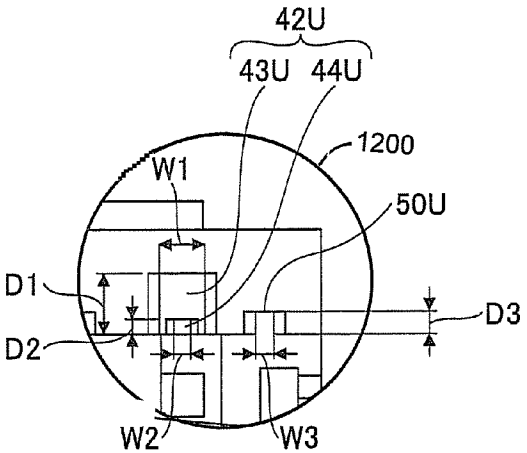
FIGS. 12A, 12B, and 12C are rear (Y1) side views of the housing according to an embodiment of the present invention.
Figure 12C:
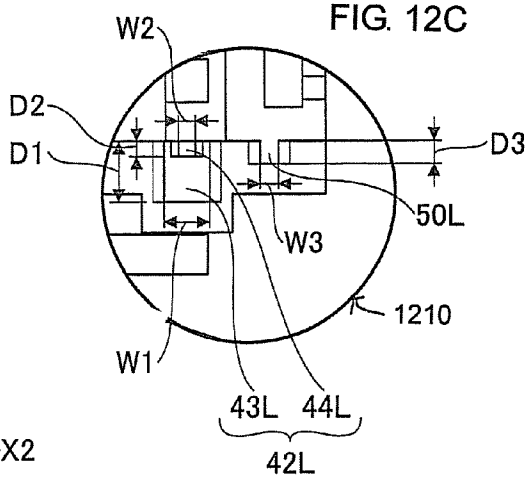
Figure 12A:
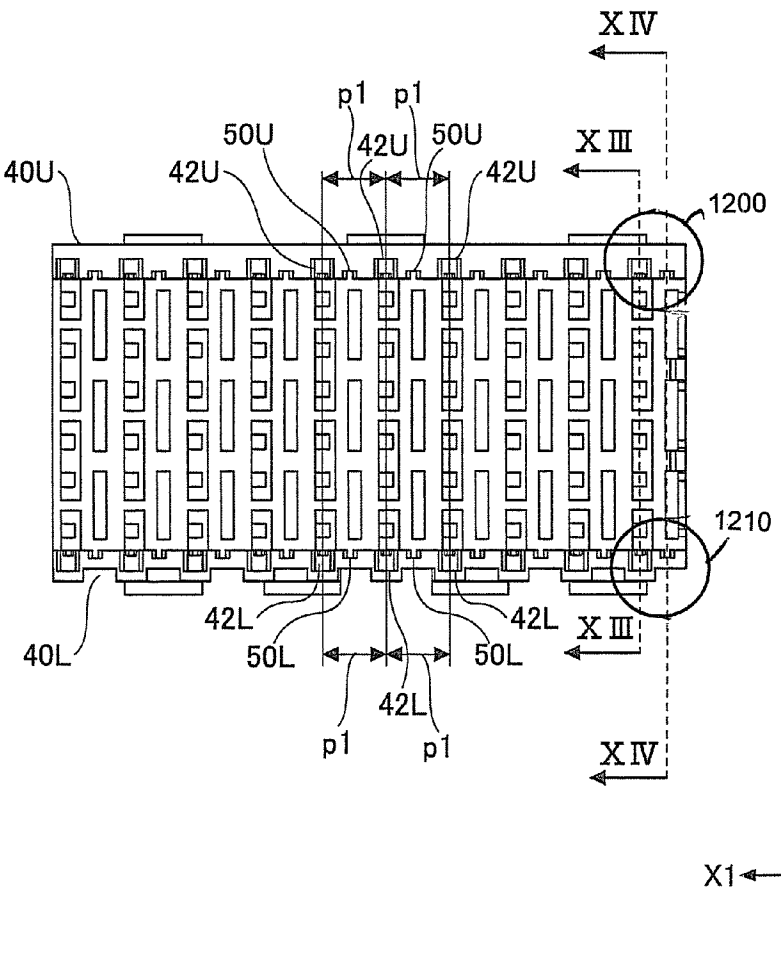
Figure 13:
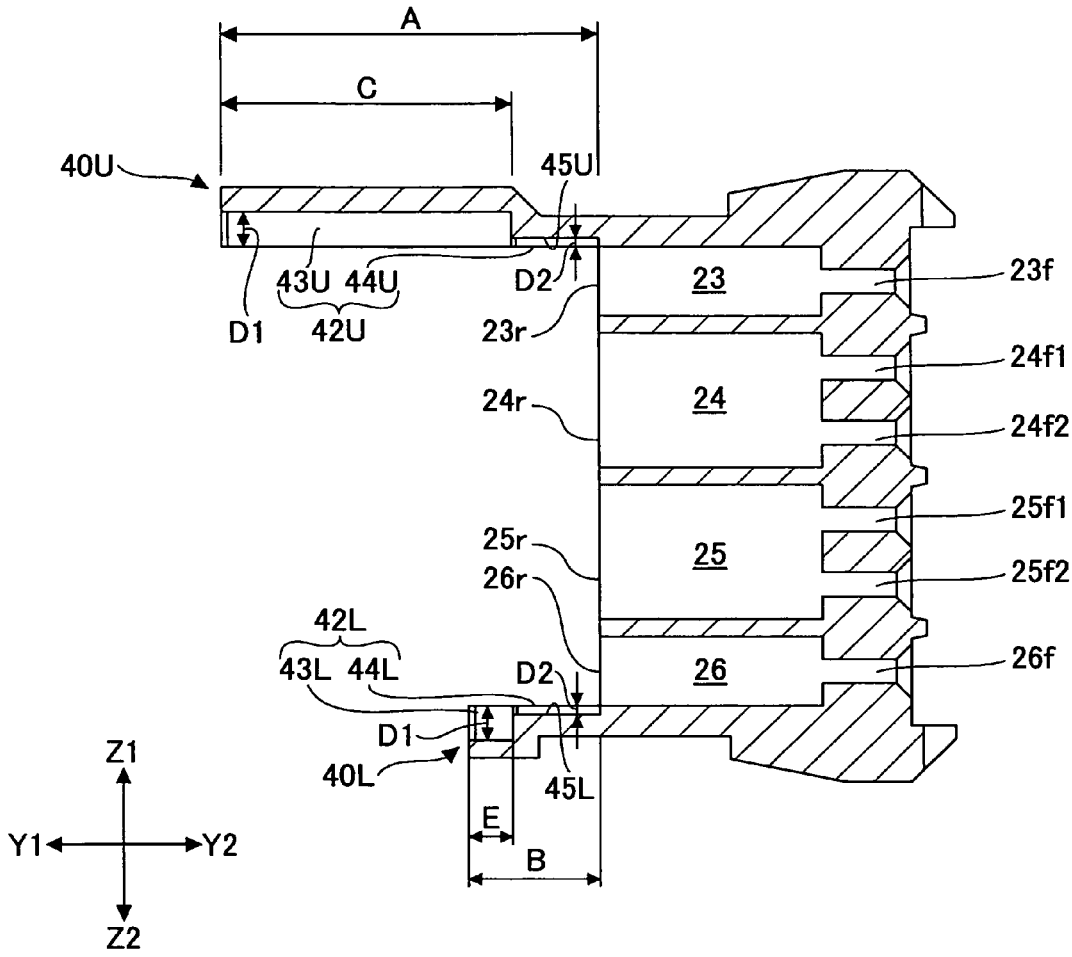
FIG. 13 is a cross-sectional view of the housing shown in FIG. 12A, taken along the line XIII-XIII, according to the embodiment of the present invention.
Figure 14:
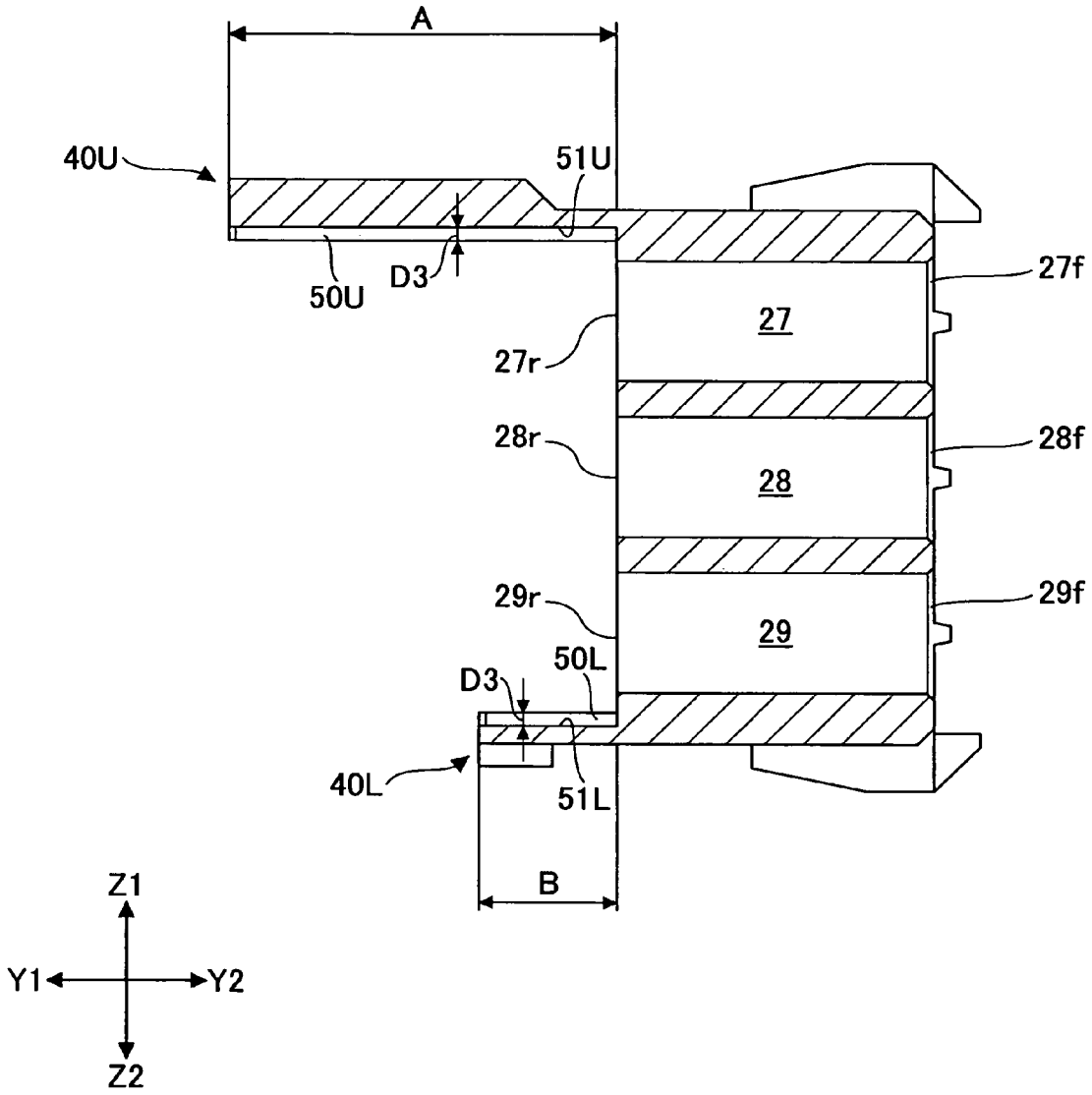
FIG. 14 is a cross-sectional view of the housing shown in FIG. 12A, taken along the line XIV-XIV, according to the embodiment of the present invention.

FIG. 11 is a rear-side perspective view of the housing 21. FIG. 12A is a rear (Y1) side view of the housing 21 shown in FIG. 11. FIGS. 12B and 12C are enlarged views respectively of portion 1200 and portion 1210 in FIG. 12A. FIG. 13 is a cross-sectional view of the housing 21 shown in FIG. 12A, taken along the line XIII-XIII. FIG. 14 is a cross-sectional view of the housing 21 shown in FIG. 12A, taken along the line XIV-XIV.

Figure 15:
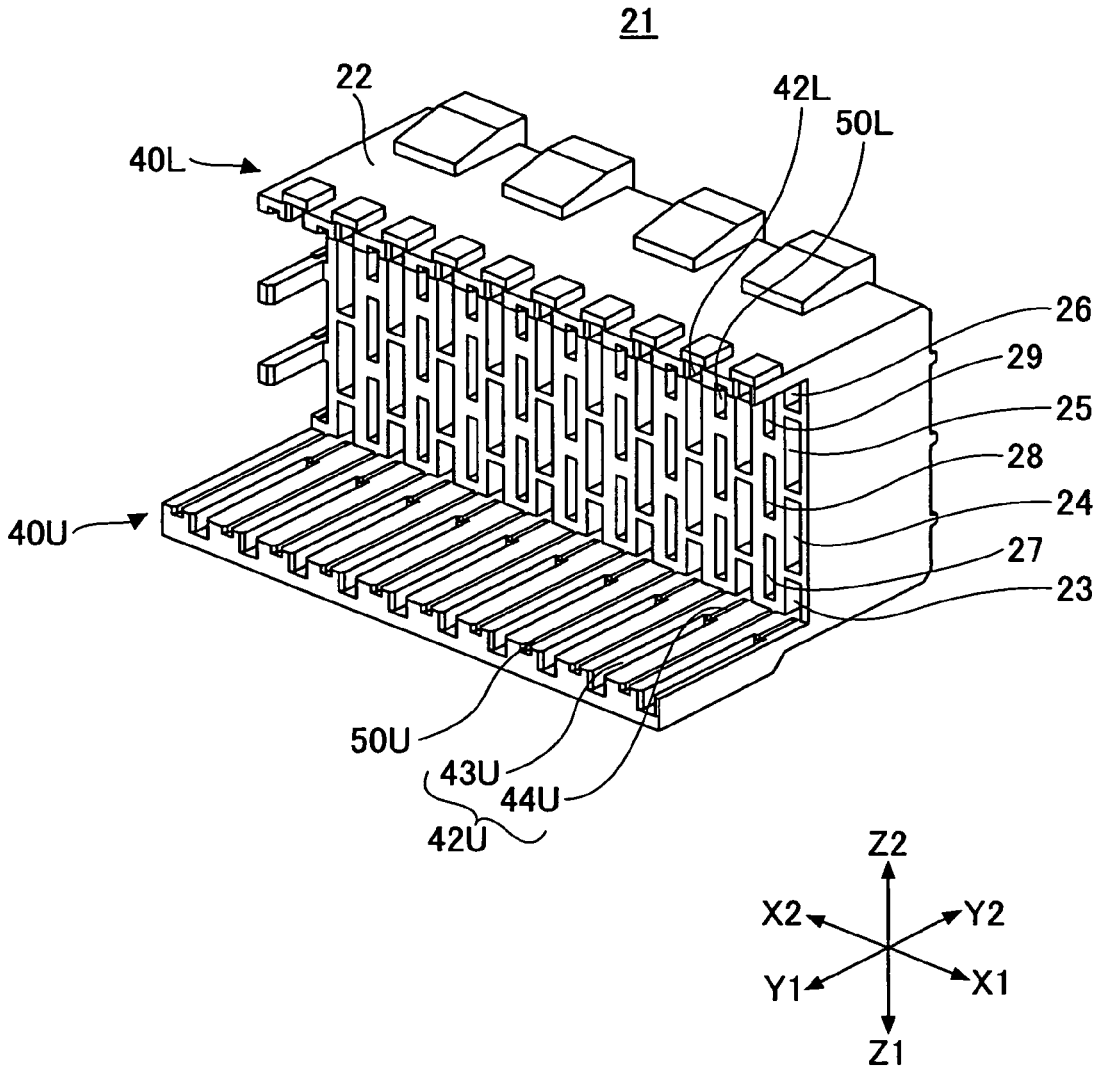
FIG. 15 is a perspective view of the housing in an upside-down position according to the embodiment of the present invention.
Figure 16B:
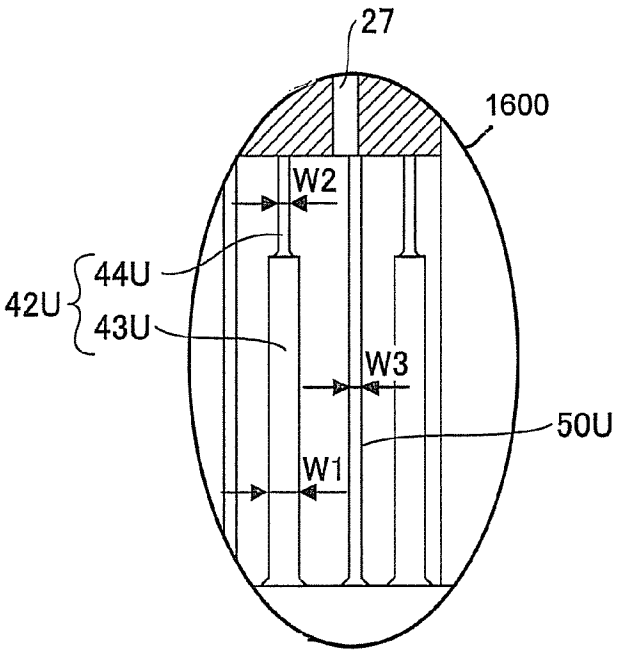
FIGS. 16 A and 16B are cutaway bottom views of the housing (or a cutaway plan view of the housing in the position shown in FIG. 15) according to the embodiment of the present invention.
Figure 16B:
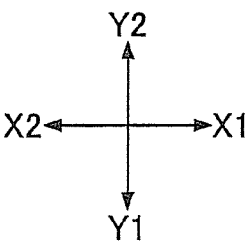
Figure 16A:
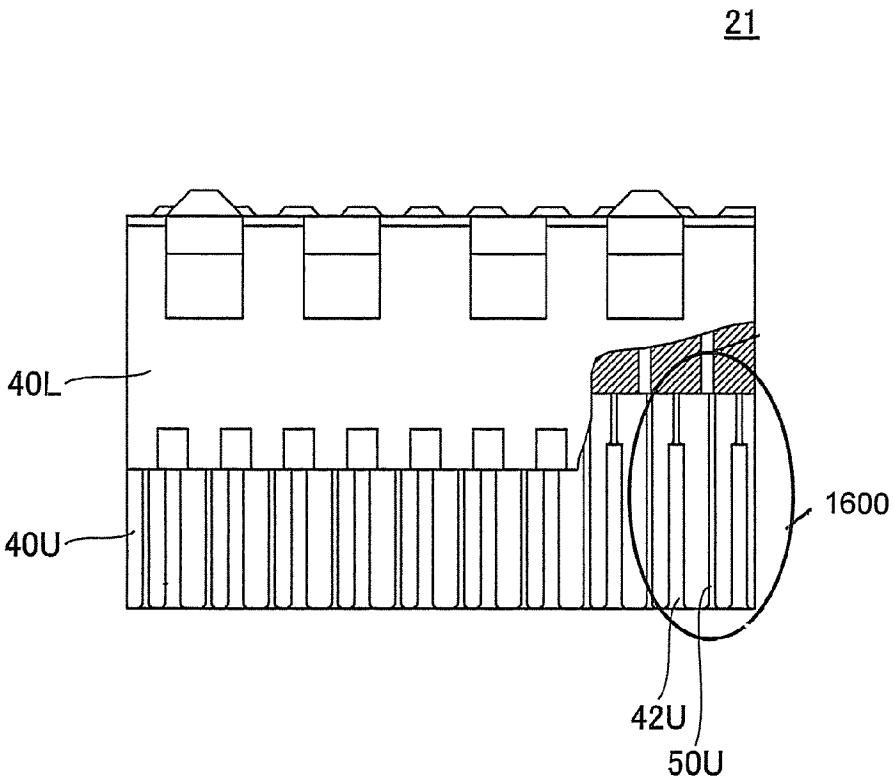

FIG. 15 is a perspective view of the housing 21 in an upside-down position. FIGS. 16A and 16B are cutaway bottom views of the housing 21 (or a cutaway plan view of the housing 21 in the position shown in FIG. 15). FIG. 16B is an enlarged view of portion 1600 illustrated in FIG. 16A.

Referring to FIGS. 11 through 16A and 16B, the housing 21, which is an electrically insulating molded component of synthetic resin, has a main body 22 on the front side and projecting parts 40U and 40L on the rear side.

The main body 22 is a substantially rectangular parallelepiped. Chambers for contact parts (contact part chambers) 23, 24, 25, and 26 for accommodating the forked contact parts 101*a*, 102*a*, 103*a*, 104*a*, 105*a*, and 106*a* (described below) and the pin contacts 13 and chambers for shield piece parts (shield piece part chambers) 27, 28, and 29 for accommodating the forked shield piece parts 122, 123, and 124 (described below) are regularly formed in the main body 22. The four contact part chambers 23, 24, 25, and 26 are aligned in the Z1-Z2 directions (from Z1 to Z2) for each contact module 100. The three shield piece part chambers 27, 28, and 29 are aligned in the Z1-Z2 directions (from Z1 to Z2) for each shield member 120.

With respect to the X1-X2 directions, the contact part chambers 23, 24, 25, and 26 and the shield piece part chambers 27, 28, and 29 are alternately arranged. The contact part chambers 23, 24, 25, and 26 have the respective openings 23*f*, 24*f*1, 24*f*2, 25*f*1, 25*f*2, and 26*f* on the front side and respective openings 23*r*, 24*r*, 25*r*, and 26*r* on the rear side. The shield piece part chambers 27, 28, and 29 have the respective openings 27*f*, 28*f*, and 29*f* on the front side and respective openings 27*r*, 28*r*, and 29*r* on the rear side.

Each of the Z1-side projecting part 40U and the Z2-side projecting part 40L is shaped like a rectangular plate. The projecting dimension A of the projecting part 40U in the Y1 direction is approximately three times as long as the projecting dimension B of the projecting part 40L in the Y1 direction. A Y1-side end face 41U of the projecting part 40U and a Y1-side end face 41L of the projecting part 40L are both flat surfaces, so that it is easy to manufacture a metal mold for molding the housing 21.

On the lower (Z2) side (surface) of the projecting part 40U, upper guide grooves for contact modules (contact module upper guide grooves) 42U and upper guide grooves for shield members (shield member upper guide grooves) 50U are alternately formed to extend in the Y1-Y2 directions. Likewise, on the upper (Z1) side (surface) of the projecting part 40L, lower guide grooves for contact modules (contact module lower guide grooves) 42L and lower guide grooves for shield members (shield member lower guide grooves) 50L are alternately formed to extend in the Y1-Y2 directions. The guide grooves 42U and the guide grooves 42L are positioned on the Z axis. The guide grooves 50U and the guide grooves 50L are also positioned on the Z axis.

As shown in particular in FIGS. 13 and 15, the guide grooves 42U are formed at positions corresponding to the contact part chambers 23. Each guide groove 42U includes a first guide groove part 43U on the Y1 side and a second guide groove part 44U serving as an extension guide groove on the Y2 side. The first guide groove part 43U extends for a length (dimension) C from the end face 41U, and has a width W1 (FIGS. 12A, 12B, 12C, 16A and 16B) and a depth D1. The second guide groove part 44U next to the first guide groove part 43U has a width W2 (FIGS. 12A, 12B, 12C, 16A and 16B) and a depth D2. The width W1 is greater than the width W2 (W1>W2) and the depth D1 is greater than the depth D2 (D1>D2). Further, the dimension C is approximately 6 mm.

The width W1 of the first guide groove part 43U is approximately a third of the thickness T1 (FIGS. 18A and 18B) of a main body part 110 of the contact module 100. The second guide groove part 44U extends from the widthwise center part of the first guide groove part 43U.

The first guide groove part 43U is sized so that an upper guide rail part 111U (FIGS. 17A and 17B) of the contact module 100 fits into the first guide groove part 43U without play. The second guide groove part 44U is sized so that an upper bulge part 101*c* (FIGS. 17A and 17B) of the contact module 100 fits into the second guide groove part 44U and bites or presses against a ceiling part 45U thereof.

As shown in particular in FIGS. 14, 16A and 16B, the shield member upper guide grooves 50U are formed at positions corresponding to the shield piece part chambers 27. Each shield member upper guide groove 50U has a width W3 and a depth D3, which are substantially the same as the width W2 and the depth D2, respectively, of the second guide groove part 44U. The shield member upper guide groove 50U is sized so that an upper bulge part 130U (FIG. 19) of the shield member 120 fits into the guide groove 50U and bites or presses against a ceiling part 51U thereof.

As shown in FIGS. 11, 13, and 14, the contact module lower guide grooves 42L and the shield member lower guide grooves 50L are formed at positions corresponding to the contact part chambers 26 and the shield piece part chambers 29, respectively, on the upper (Z1) side (surface) of the Z2-side projecting part 40L. Each lower guide groove 42L includes a first guide groove part 43L and a second guide groove part 44L serving as an extension guide groove. The first guide groove part 43L has the same width W1 and depth D1 as the first guide groove part 43U formed in the projecting part 40U. The second guide groove part 44L has the same width W2 and depth D2 as the second guide groove part 44U formed in the projecting part 40U. The first guide groove part 43L has a length (dimension) E.

The first guide groove part 43L is sized so that a lower guide rail part 111L (FIGS. 17A and 17B) of the contact module 100 fits into the first guide groove part 43L without play. The second guide groove part 44L is sized so that a lower bulge part 106*c* (FIGS. 17A and 17B) of the contact module 100 fits into the second guide groove part 44L and bites a bottom plate part 45L thereof.

The guide groove 50L has the same width W3 and depth D3 as the guide groove 50U formed in the projecting part 40U. The guide groove 50L is sized so that a lower bulge part 130L (FIG. 19) of the shield member 120 fits into the guide groove 50L and bites a bottom part 51L thereof.

Here, the width W1 of the first guide groove parts 43U and 43L is less than the thickness T1 of the main body part 110 of the contact module 100 described below, which makes it possible to form the shield member upper and lower guide grooves 50U and 50L.

[Configuration of Contact Module 100]

Figure 17A:
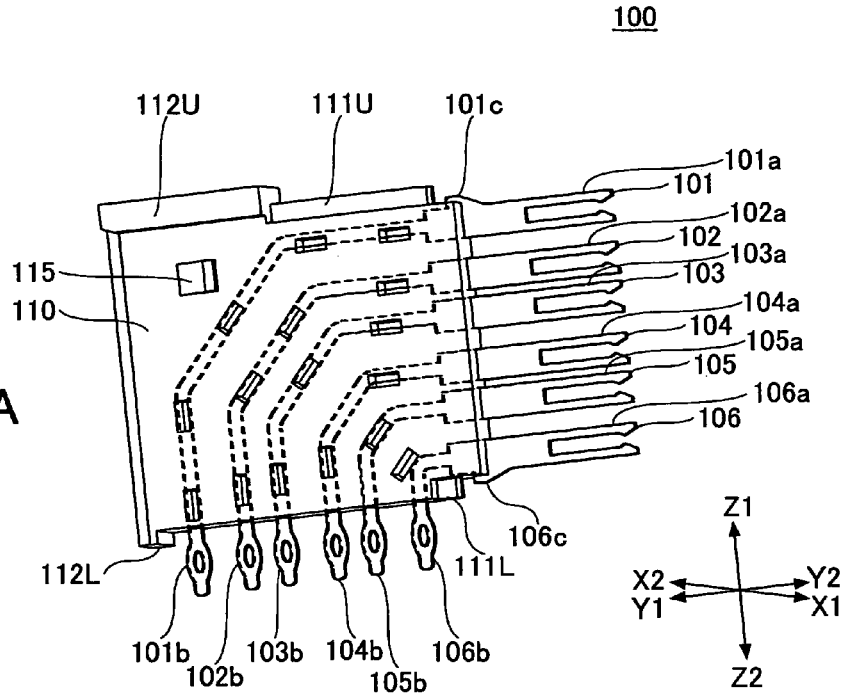
FIGS. 17A and 17B are perspective views of the contact module from different directions according to the embodiment of the present invention.
Figure 17B:
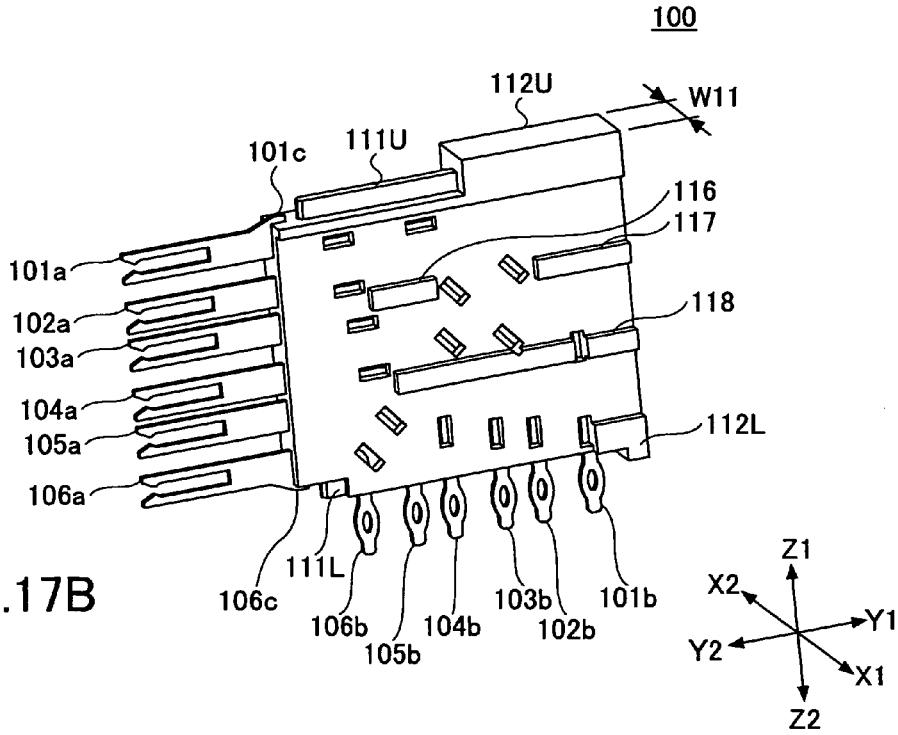
Figure 18C:
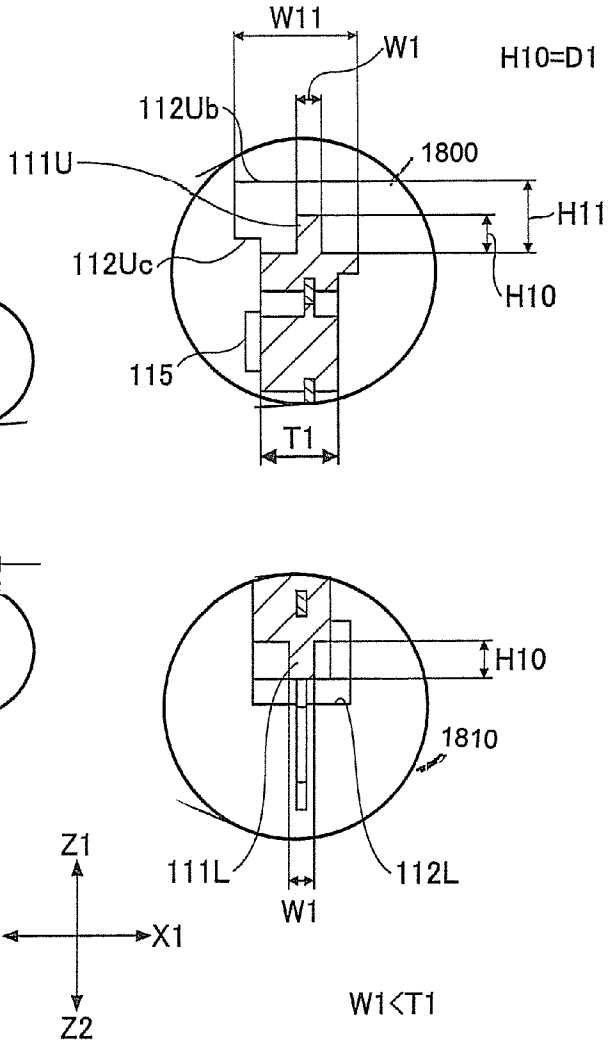
Figure 18B:
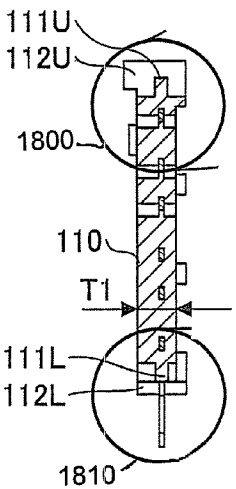
Figure 18A:
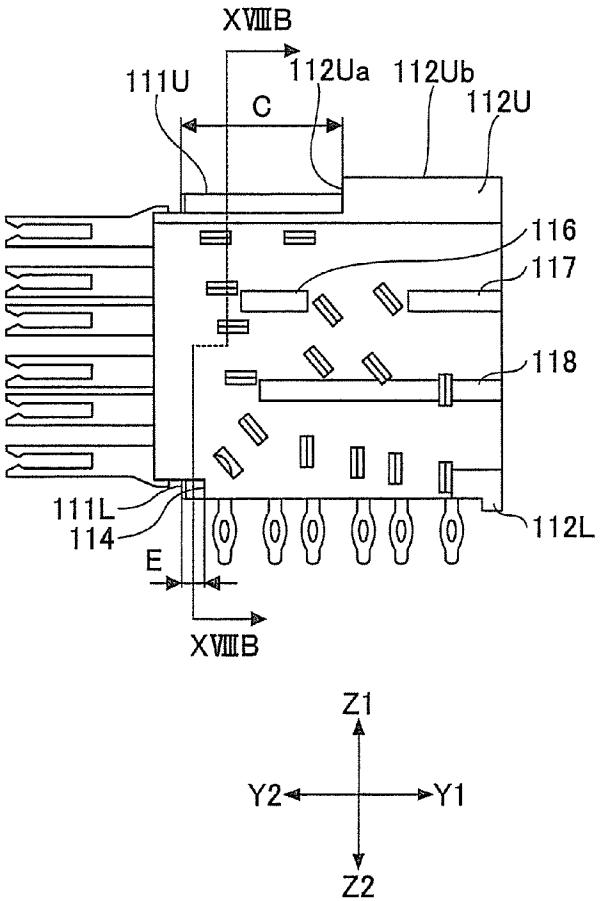
FIG. 18A is an X1-side view of the contact module.

FIGS. 17A and 17B are perspective views of the contact module 100 from different directions. FIG. 18A is an X1-side view of the contact module 100, and FIG. 188 is a cross-sectional view of the contact module 100 of FIG. 18A, taken along the line XVIIIB-XVIIIB. FIGS. 18C and 18D are enlarged views respectively of portion 1800 and portion 1810 illustrated in FIG. 18B.

The contact module 100 is a plate-like insert-molded component. The contact module 100 includes the substantially L-letter shaped contact members 101 through 106 and the electrically insulating main body part 110 that encloses the center portions of the contact members 101 through 106 and holds them in alignment. The main body part 110 has a substantially square plate shape and has the thickness T1.

The contact members 101, 102, 103, 104, 105, and 106 have their respective forked contact parts 101*a*, 102*a*, 103*a*, 104*a*, 105*a*, and 106*a* at one end, and have respective press-fit terminal parts 101*b*, 102*b*, 103*b*, 104*b*, 105*b*, and 106*b* at the other end. The forked contact parts 101*a* through 106*a* project in the Y2 direction from the main body part 110 and are arranged in the Z1-Z2 directions. The press-fit terminal parts 101*b* through 106*b* project in the Z2 direction from the main body part 110 and are arranged in the Y1-Y2 directions.

The contact members 102 and 103 form a differential transmission pair, and the contact members 104 and 105 form a differential transmission pair.

The outermost contact member 101 has the bulge part 101*c* projecting in the Z1 direction at the root of the forked contact part 101*a*.

The innermost contact member 106 has the bulge part 106*c* projecting in the Z2 direction at the root of the forked contact part 106*a*.

The bulge part 101*c* and the bulge part 106*c* serve as a first bulge part.

The main body part 110 has the guide rail part 111U and a flange part 112U on its Z1 side end face, and has the guide rail part 111L and a flange part 112L on its Z2 side end face.

The guide rail part 111U is formed on the substantially Y2-side half of the Z1 end face of the main body part 110. The flange part 112U is formed on the substantially Y1-side half of the Z1 end face of the main body part 110. The guide rail part 111L is formed at the Y2 end of the Z2 end face of the main body part 110. The flange part 112L is formed at the Y1 end of the Z2 end face of the main body part 110.

The guide rail part 111U is formed in the widthwise center of the Z1 end face of the main body part 110, and has a rectangular cross section. The guide rail part 111U has a size corresponding to the above-described first guide groove part 43U, and has the width W1, a height H10 corresponding to the depth D1, and the length C. The width W1, which is less than the thickness T1 of the main body part 110, is approximately a third of the thickness T1.

The flange part 112U has a rectangular cross section greater than the cross section of the guide rail part 111U. The flange part 112U has a height H11 and a width W11 corresponding to a pitch p1 (FIG. 12A) with which the upper and lower guide grooves 42U and 42L are respectively arranged. The flange part 112U has an end face 112Ua on the guide rail part 111U side, an upper surface 112Ub, and an X2-side cutout part 112Uc on the lower side.

The guide rail part 111L has a size corresponding to the first guide groove part 43L, and has the length E, the width W1, and the height H10.

The main body part 110 has an end face 114 on the guide rail part 111L side.

The flange part 112L projects in the X1 and Z2 directions from the main body part 110, but not in the X2 direction.

As described below, the cutout part 112Uc exposes the entrance of the corresponding guide groove 50U. The shape of the flange part 112L exposes the entrance of the corresponding guide groove 50L.

Further, the main body part 110 has a rectangular projection 115 on its X2 side (surface), and has multiple ribs 116, 117, and 118 extending in the Y1-Y2 directions on its X1 side (surface). The projection 115 increases its thickness in the Y2 direction so as to facilitate incorporation of the shield member 120.

[Shape of Shield Member 120]

Figure 19:
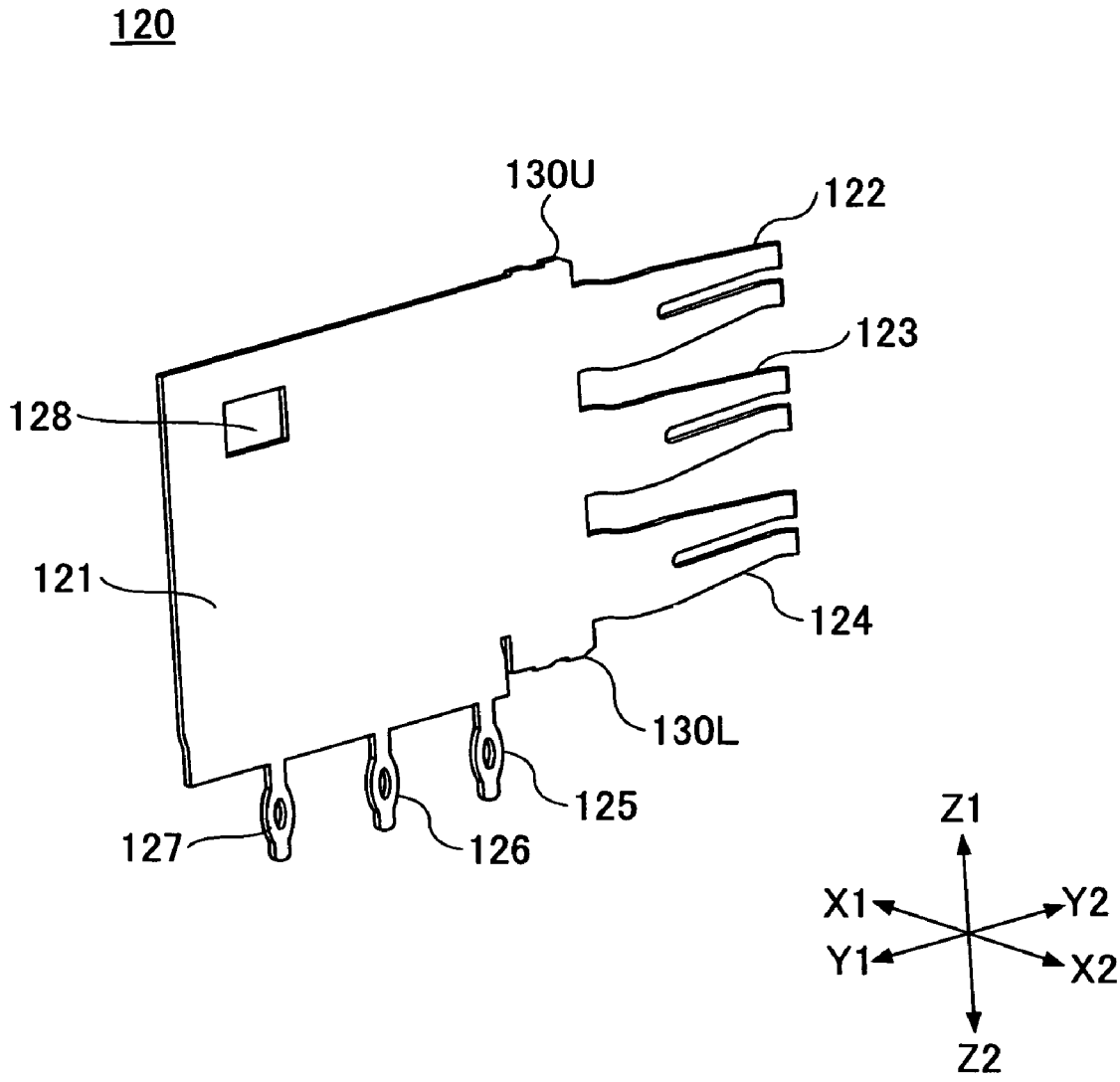
FIG. 19 is a perspective view of the shield member according to the embodiment of the present invention.

FIG. 19 is a perspective view of the shield member 120. The shield member 120, which is shaped like a plate, includes a rectangular main body part 121, the forked shield piece parts 122, 123, and 124, and press-fit terminal parts 125, 126, and 127. The shield piece parts 122, 123, and 124 project in the Y2 direction from the main body part 121 and are arranged in the Z1-Z2 directions. The press-fit terminal parts 125, 126, and 127 project in the Z2 direction from the main body part 121 and are arranged in the Y1-Y2 directions.

The main body part 121 has a quadrilateral opening 128 formed therein. Further, the main body part 121 has the bulge part 130U and the bulge part 130L formed at its Y2 end to project in the Z1 and Z2 directions, respectively. The bulge parts 130U and 130L serve as a second bulge part.

[Configuration of Socket Connector 20]

Referring to FIGS. 3 through 10A and 10B, according to the socket connector 20, the contact modules 100 and the shield members 120 are inserted into the housing 21 from its rear side so as to be alternately arranged in the longitudinal directions of the housing 21 (socket connector 20). That is, the shield members 120 are positioned in the corresponding narrow gaps each formed between the corresponding adjacent two of the contact modules 100.

Referring to FIGS. 6A, 6B, 6C, 7A, 7B, and 7C, P1 and P2 show the positions at which the contact module 100 is fixed to the housing 21, Q1 and Q2 show the positions at which the shield member 120 is fixed to the housing 21, and R shows the position at which the shield member 120 and the contact module 100 are coupled and fixed to each other.

The forked contact parts 101*a* through 106*a* are housed in the corresponding contact part chambers 23, 24, 25, and 26; the guide rail part 111U is fitted into the first guide groove part 43U over the length C; the guide rail part 111L is fitted into the first guide groove part 43L over the length E; the bulge part 101*c* is fitted into the second guide groove part 44U and bites its ceiling part 45U (P1); the bulge part 106*c* is fitted into the second guide groove part 44L and bites the bottom plate part 45L thereof (P2); the end face 112Ua abuts the end face 41U of the projecting part 40U; and the end face 114 abuts the end face 41L of the projecting part 40L. The individual contact modules 100 are thus attached to the housing 21 in alignment in the X1-X2 directions. The flange parts 112U are tightly or gaplessly arranged. The upper surfaces 112Ub of the flange parts 112U are level with the upper surface of the projecting part 40U.

The flange parts 112U of each adjacent two of the contact modules 100 are tightly or gaplessly arranged.

FIGS. 7A and 7C are enlarged views respectively of portion 700 and portion 710 illustrated in FIG. 7B. As shown in particular in FIG. 7B, the forked shield piece parts 122, 123, and 124 are housed in the corresponding shield piece part chambers 27, 28, and 29; the bulge part 130U is fitted into the guide groove 50U and bites its ceiling part 51U (Q1); the bulge part 130L is fitted into the guide groove 50L and bites its bottom part 51L (Q2); the main body part 121 is positioned in the narrow gap between the adjacent contact modules 100; and the opening 128 engages the projection 115 of the corresponding contact module 100 (R) to be coupled and fixed thereto. The individual shield members 120 are thus attached to the housing 21.

[Relationship of Fixation of Housing 21, Contact Module 100, and Shield Member 120]

Here, a description is given of the relationship of fixation of the housing 21, the contact module 100, and the shield member 120.

The contact module 100 is fixed to the housing 21 at the positions P1 and P2 so as to prevent the contact module 100 from coming out from the housing 21. The shield member 120 is also fixed to the housing 21 at the positions Q1 and Q2 so as to prevent the shield member 120 from coming out from the housing 21. The shield member 120 and the contact module 100 are coupled and fixed to each other at the position R. Therefore, the contact module 100 is prevented from coming out from the housing 21 by not only the fixation of the contact module 100 itself at the positions P1 and P2 but also the fixation of the shield member 120 at the positions Q1 and Q2. The shield member 120 serves as an anchor against the coming-out of the contact module 100 from the housing 21. Therefore, the contact module 100 is prevented from coming out from the housing 21 with a force greater than in the conventional socket connector, which relies on only the fixation of the contact module itself at the contact positions with the housing to prevent the contact module from coming out from the housing. Therefore, in the socket connector 20 of this embodiment, the alignment of the contact modules 100 is not disordered even by application of a force of such strength as to disorder the alignment of contact modules in the conventional socket connector.

The shield member 120 is prevented from coming out from the housing in the Y1 direction by the upper and lower bulge parts 130U and 130L biting the guide grooves 50U and 50L, respectively, and by the opening 128 fitting around the projection 115.

[Alignment Condition in Case where Contact Module 100 Slightly Comes Out from Housing 21]

The contact module 100 has its guide rail part 111U fitting into the first guide groove part 43U over the length C and has its guide rail part 111L fitting into the first guide groove part 43L over the length E. Therefore, even if the contact module 100 is slightly displaced to come off from the housing 21 in the Y1 direction for reasons such as receiving a significantly strong impact during handling of the socket connector 20, neither does the guide rail part 111U come off from the guide groove part 43U nor does the guide rail part 111L come off from the guide groove part 43L. Accordingly, the fitting of the guide rail part 111L and the first guide groove part 43L and, in particular, the fitting of the guide rail part 111U and the first guide groove part 43U are maintained. Therefore, the restriction on the position of the contact module 100 relative to the housing 21 is maintained with respect to the X1-X2 directions. Accordingly, the contact module 100 is prevented from becoming loose and remains in the same position as its original position with respect to the X1-X2 directions, so that the alignment of the contact modules 100 is immediately restored by an operator simply pushing in the displaced contact module 100.

Here, even if the contact module 100 is displaced so much in the Y1 direction that the guide rail part 111L comes out from the first guide groove part 43L, the guide rail part 111U is prevented from coming out from the first guide groove part 43U, so that the restriction on the position of the contact module 100 relative to the housing 21 is maintained with respect to the X1-X2 directions.

Thus, according to one aspect of the present invention, shield members are fixed to the housing of a socket connector. Accordingly, the shield members function as anchors against the coming-out of corresponding contact modules from the housing. As a result, the contact modules are prevented from coming out from the housing with a force greater than conventionally, and the contact modules are kept in alignment with greater strength.

The present invention is not limited to the specifically disclosed embodiment, and variations and modifications may be made without departing from the scope of the present invention.

What is claimed is:

1. A socket connector, comprising:

a housing including a main body and a projecting part projecting from the main body;

a plurality of contact modules each including a contact member and a plate-shaped main body part enclosing the contact member; and a plurality of shield members coupled and fixed to the corresponding contact modules, wherein the contact modules and the shield members are alternately arranged in alignment in the housing in a longitudinal direction thereof, the projecting part of the housing includes a plurality of guide grooves configured to guide the corresponding shield members, the guide grooves being formed on a first surface and a second surface of the projecting part, the first surface and the second surface facing toward each other, and each of the shield members includes a bulge part and is fixed to the housing by the bulge part fitting into and biting the corresponding guide groove.

2. A socket connector, comprising:

a housing including a main body and a projecting part projecting from the main body;

a plurality of contact modules each including a contact member and a plate-shaped main body part holding the contact member; and a plurality of shield members, wherein the contact modules and the shield members are alternately arranged in alignment in the housing in a longitudinal direction thereof, each of the contact modules includes a guide rail part and a first bulge part, the guide rail part having a dimension less than a dimension of the main body part in the longitudinal direction of the housing, each of the shield members includes a second bulge part, the projecting part includes alternately arranged first guide grooves and second guide grooves, the first guide grooves corresponding to the guide rail parts and the second guide grooves guiding the shield members, each of the contact modules is fixed to the housing by the guide rail part fitting into the corresponding first guide groove and the first bulge part being fixed to the housing, each of the shield members is fixed to the housing by the second bulge part fitting into and biting the corresponding second guide groove, and the shield members are coupled and fixed to the corresponding contact modules.

3. The socket connector as claimed in claim 2, wherein:

the projecting part includes an extension guide groove extending from an end of each of the first guide grooves, the extension guide groove having a dimension less than a dimension of the first guide groove in the longitudinal direction of the housing, and the first bulge part of each of the contact modules fits into and bites the corresponding extension guide groove so as to be fixed to the corresponding extension guide groove.

4. The socket connector as claimed in claim 2, wherein:

each of the contact modules includes a projection projecting toward an adjacent one of the contact modules, each of the shield members has an opening formed therein, and the openings of the shield members are fitted to the projections of the corresponding contact modules so that the shield members are coupled and fixed to the corresponding contact modules.

5. The socket connector as claimed in claim 2, wherein the projecting part has a flat end face.

6. The socket connector as claimed in claim 5, wherein:

each of the contact modules includes a flange part having a dimension greater than the dimension of the main body part in the longitudinal direction of the housing and abutting the end face of the projecting part, and the flange part includes a cutout part configured to expose an entrance of the second guide groove guiding the corresponding shield member.

7. A socket connector, comprising:

a housing having a first surface and a second surface facing toward each other and including a plurality of grooves formed on the first surface and the second surface;

a plurality of contact modules fixed to the housing; and a plurality of shield members coupled and fixed to the corresponding contact modules, the shield members having respective bulge parts being directly fixed to the first surface and a second surface of the housing with the bulge parts fitting into and biting the corresponding grooves, wherein the contact modules and the shield members are alternately arranged in alignment in a longitudinal direction of the housing, and the shield members are directly fixed to the first surface and the second surface of the housing.

8. The socket connector is claimed in claim 7, wherein:

each of the contact module includes a rectangular projection projecting in a direction toward an adjacent one of the contact modules, the shield members include respective openings engaging the corresponding rectangular projections of the contact modules, and a thickness of each of the rectangular projections varies in the direction toward the adjacent one of the contact modules to facilitate incorporation of the corresponding shield member.

* * * * *